US006492081B2

(12) United States Patent
Morikawa et al.

(10) Patent No.: US 6,492,081 B2
(45) Date of Patent: Dec. 10, 2002

(54) ELECTROPHOTOGRAPHIC PHOTOSENSITIVE MEMBER, AND PROCESS CARTRIDGE AND ELECTROPHOTOGRAPHIC APPARATUS INCLUDING THE PHOTOSENSITIVE MEMBER

(75) Inventors: Yosuke Morikawa, Yokohama; Kouichi Nakata, Numazu; Hiroshi Saito, Shizuoka-ken, all of (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 09/883,337

(22) Filed: Jun. 19, 2001

(65) Prior Publication Data

US 2002/0034701 A1 Mar. 21, 2002

(30) Foreign Application Priority Data

Jun. 21, 2000 (JP) ..... 2000-186199

(51) Int. Cl.[7] ..... G03G 5/147
(52) U.S. Cl. ..... 430/66; 430/67; 399/147
(58) Field of Search ..... 430/66, 67; 399/147

(56) References Cited

U.S. PATENT DOCUMENTS 4,409,309 A 10/1983 Oka ..... 430/65
5,693,443 A * 12/1997 Nakamura et al. ..... 430/66
5,728,499 A * 3/1998 Hung et al. ..... 430/66
6,030,733 A 2/2000 Kami et al. ..... 430/56

FOREIGN PATENT DOCUMENTS

| | | |
|---|---|---|
| EP | 0 775 942 | 5/1997 |
| JP | 57 30846 | 2/1982 |
| JP | 62 19254 | 1/1987 |
| JP | 1 306857 | 12/1989 |
| JP | 2 50167 | 2/1990 |
| JP | 5 181299 | 7/1993 |

OTHER PUBLICATIONS

Database WPI, Section Ch, Week 199050, Derwent Publ. AN 1990–373167, XP002183257 for JP 02–271363.

Database WPI, Section Ch, Week 199031, Derwent Publ. AN 1990–234572, XP002183049, for JP 02–161449.

* cited by examiner

*Primary Examiner*—John Goodrow
(74) *Attorney, Agent, or Firm*—Fitzpatrick, Cella, Harper & Scinto

(57) ABSTRACT

An electrophotographic photosensitive member exhibiting a good durability and stable electrophotographic performances regardless of environmental change is provided by coating the photosensitive layer with a specific protective layer. The protective layer has a thickness of 1–7 $\mu$m and comprises a cured phenolic resin and metal particles or metal oxide particles dispersed therein.

14 Claims, 2 Drawing Sheets

ELECTROPHOTOGRAPHIC PHOTOSENSITIVE MEMBER, AND PROCESS CARTRIDGE AND ELECTROPHOTOGRAPHIC APPARATUS INCLUDING THE PHOTOSENSITIVE MEMBER

FILED OF THE INVENTION AND RELATED ART

The present invention relates to an electrophotographic photosensitive member, particularly to one characterized by having a protective layer comprising specific particles and a specific resin, and also to a process cartridge and an electrophotographic apparatus including such a photosensitive member.

An electrophotographic photosensitive member is subjected to a repetition of an image forming cycle including steps of charging, exposure, development, transfer, cleaning, charge removal, etc. An electrostatic latent image formed by the charging and exposure is developed with a fine powdery developer called a toner to form a toner image on the photosensitive member. The toner image is then transferred onto a transfer(-receiving) material, such as paper, but all the toner is not transferred but a portion thereof remains as a residual toner on the photosensitive member.

A large amount of the residual toner, if caused, can promote a further transfer failure to result in a toner image on the transfer material with noticeable lack of portion of image and image uniformity. Further, the residual toner causes problems, such as melt-sticking and filming of the toner onto the photosensitive member. In order to cope with these problems, an electrophotographic photosensitive member is required to have a surface layer with improved releasability.

Further, an electrophotographic photosensitive member is subjected to direct application of electrical and mechanical external forces, so that the photosensitive member is required to be durable against such forces. More specifically, the photosensitive member is required to be durable against the occurrences of surface abrasion and scars due to rubbing and surface layer degradation due to attachment of active substances, such as ozone and $NO_x$ occurring during the charging of the photosensitive member.

In order to comply with the above-mentioned requirements of the photosensitive member, it has been proposed to dispose various protective layers. For example, Japanese Laid-Open Patent Application (JP-A) 57-30846 discloses a protective layer comprising a resin to which a metal oxide is added as electroconductive power for resistivity control.

The dispersion of electroconductive powder in such a protective layer of an electrophotographic photosensitive member is performed principally for the purpose of controlling the electrical resistivity of the protective layer per se to prevent an increase in residual potential in the photosensitive member liable to be caused along with the repetition of the electrophotographic image forming cycles. It is known than an appropriate range of volume resistivity of a protective layer is $10^{10}$ to $10^{15}$ ohm.cm. The resistivity in the above-mentioned range of protective layer is liable to be affected by ionic conduction and is therefor liable to result in a remarkable change in resistivity due to an environmental change. Particularly, in the case of a resinous film containing metal oxide powder dispersed therein, it has been very difficult to keep the resistivity of the protective layer in the above-mentioned range under various environmental conditions since the metal oxide powder surface exhibits a high moisture absorptivity. Further, many resins per se exhibit high moisture absorptivity and are liable to lower the resistivity of the protective layer formed therefrom.

Particularly, in a high-humidity environment, the surface layer of a photosensitive member is liable to have a lower resistivity by standing or repetitive surface-attachment of active substances, such as ozone and $NO_X$, and also cause a lowering in toner releasability, thus causing image defects such as image flow and insufficient image uniformity.

In the case of dispersing electroconductive particles in a protective layer, it is generally preferred that the particles have a particle size (diameter) smaller than the wavelength of light incident thereto, that is, at most 0.3 $\mu$m, in order to prevent the scattering of incident light due to the dispersed particles. Moreover, electroconductive particles generally tend to agglomerate with each other when dispersed in a resin solution, are difficult to disperse, and even if once dispersed, are liable to cause secondary agglomeration or precipitation, so that it has been difficult to form a resinous film in which fine particles of at most 0.3 $\mu$m in particle size are uniformly dispersed. Further, in other to provide a protective layer with a better transparency and a better uniformity of electroconductivity, it is particularly preferred to disperse fine particles (of at most 0.1 $\mu$m in primary particle size), but such fine particles are liable to exhibit even worse dispersibility and dispersion stability.

In order to alleviate the above-mentioned difficulties, JP-A 1-306857 has disclosed a protective layer containing a fluorine-containing silane coupling agent or titanate coupling agent, or a compound such as $C_7F_{15}NCO$; JP-A 62-295066 has disclosed a protective layer containing metal or metal oxide fine power subjected to a water-repelling treatment for improved dispersibility and moisture resistance dispersed in a binder resin; and JP-A 2- 50167 has disclosed a protective layer containing metal oxide fine power surface-treated with a titanate coupling agent, a fluorine-containing silane coupling agent or acetoalkoxyaluminum diisopropylate dispersed in a binder resin.

However, even such a protective layer still shows a lower resistivity to cause image blurring in a high-humidity environment and exhibits insufficient durability against abrasion or scars due to rubbing, thus being not fully satisfactory as a protective layer for providing electrophotographic performances complying with demands for high image qualities in recent years.

On the other hand, the use of fluorinated carbon as moderately electroconductive particles together with various binder resins including a thermosetting phenolic resin for providing a protective layer has been proposed in JP-A 62-19254. However, the resultant protective layer is not sufficient with respect to dispersion of the fluorinated carbon and environmental stability of the resistivity, thus being liable to result in increases in resistivity and residual potential in a low humidity environment, and a lower humidity to cause image blurring in a high humidity environment.

The use of various thermosetting resins, inclusive of a phenolic resin, together with various filler materials, inclusive of a metal oxide, for providing a protective layer, has been proposed in JP-A 5-181299. However, the metal oxide fine particles disclosed therein are non-conductive reinforcing particles preferably having a particle size of 0.05–3 $\mu$m. Accordingly, the metal oxide particles are not effective for providing a protective layer exhibiting a low resistivity, and a sufficient consideration has not been paid to the provision of a transparent protective layer.

As described above, it has been very difficult to realize a protective layer satisfying various properties required thereof at a high level.

SUMMARY OF THE INVENTION

Accordingly, a generic object of the present invention is to provide an electrophotographic photosensitive member having solved the above-mentioned problems of the conventional electrophotographic photosensitive members.

A more specific object of the present invention is to provide an electrophotographic photosensitive member which is substantially free from an increase in residual potential in a low-humidity environment and is capable of providing high-quality images free from image blurring or image flow in a high-humidity environment.

Another object of the present invention is to provide an electrophotographic photosensitive member which has a surface layer exhibiting excellent releasability and excellent durability against abrasion and scars and thus can maintain high-quality images.

A further object of the present invention is to provide a process cartridge and an electrophotographic apparatus including such an electrophotographic photosensitive member.

According to the present invention, there is provided an electrophotographic photosensitive member, comprising: a support, a photosensitive layer and a protective layer in this order; wherein said protective layer has a thickness of 1–7 μm and comprises a cured phenolic resin and metal particles or metallic oxide particles dispersed therein.

According to the present invention, there is further provided a process cartridge, comprising: the above-mentioned electrophotographic photosensitive member and at least one means selected form the group consisting of charging means, developing means and cleaning means; said electrophotographic photosensitive member and said at least one means being integrally supported and detachably mountable to a main assembly of an electrophotographic apparatus.

The present invention further provides an electrophotographic apparatus, comprising: the abovementioned electrophotographic photosensitive member, and charging means, developing means and transfer means respectively disposed opposite to the electrophotographic photosensitive member.

These and other objects, features and advantages of the present invention will become more apparent upon a consideration of the following description of the preferred embodiments of the present invention taken in conjunction with the accompanying drawings.

DETAILED DESCRIPTION OF THE INVENTION

Figure 1A:
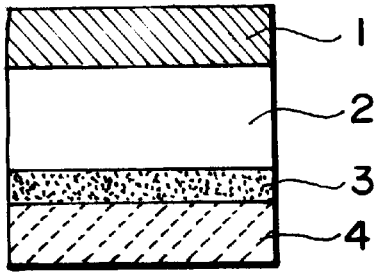
FIGS. 1A–1C are schematic sectional views each showing a laminate structure of an embodiment of the electrophotographic photosensitive member according to the invention.

The electrophotographic photosensitive member according to the present invention comprises a support, a photosensitive layer and protective layer laminated in this order, wherein the protective layer has a thickness of 1–7 μm. and comprises a cured phenolic resin and metal particles or metal oxide particles dispersed in the cured phenolic resin.

Examples of the metal particles used in the protective layer may include particles of metals such as aluminum, zinc, copper, chromium, nickel, silver, and stainless steel, and plastic particles coated with a vapor-deposited film of these metals. Examples of the metal oxide particles may include: particles of metal oxides, such as zinc oxide, titanium oxide, antimony oxide, indium oxide, bismuth oxide, tin-doped indium oxide, antimony-doped tin oxide, tantalum-doped tin oxide, and antimony-doped zirconium oxide. These metal or metal oxide particles may be used singly or in combination of two or more species. In the case of using two or more species in combination, they may be used simply in mixture or in the form of a solid solution or a melt-attached form.

The metal or metal oxide particles may preferably have a volume-average particle size of at most 0.3 μm, particularly 0.1 μm or smaller, in view of the transparency of the resultant protective layer. The average particle size may be measured by using an ultra-centrifugal particle size distribution measurement apparatus for particles in a coating liquid for the protective layer. It is also preferred that the metal or metal oxide particles exhibit a volume resistivity of $10^{-1}$–$10^{6}$ ohm.cm, more preferably $10^{0}$–$10^{5}$ ohm.cm as measured by the tablet method, wherein ca. 0.5 g of sample particles are placed in a cylinder having a bottom area of 2.23 $cm^2$ and sandwiched between a pair of electrodes under a pressure of 15 to measure a resistance value under application of 100 volts in an environment of 23° C./50% RH.

In view of the transparency of the resultant protective layer, it is particularly preferred to use metal oxide particles.

It is preferred that the protective layer further contains lubricant particles, which may preferably comprise fluorine-containing resin particles, silicon particles or silicone particles, more preferably fluorine-containing resin particles. It is also possible to use two or more specie of lubricant particles in mixture.

Examples of the fluorine-containing resin providing the preferred class of lubricant particles may include: tetrafluoro-ethylene resin, trifluorochloroethylene, hexafluoroethylene-propylene resin, vinyl fluoride resin, vinylidene fluoride resin, difluorodichloroethylene resin, and copolymers of these. These resin particles may be used singly or in combination of appropriately selected two or more species. Particles of tetrafluoroethylene resin and vinylidene fluoride resin are particularly preferred. The molecular weight and the particle size of these resin particles may appropriately selected and need not be particularly restricted.

In the case of dispersing such fluorine-containing resin particles together with the metal or metal oxide particles in a coating resin liquid of the protective layer, it is preferred to add a fluorine-containing compound in the coating liquid prior to the dispersion of the metal or metal oxide particles, or to surface-treat the metal or metal oxide particles with a fluorine-containing compound prior to the addition thereof, so as to minimize the agglomeration of the metal or metal oxide particles together with the fluorine-containing resin particles. By the addition of or surface treatment with such a fluorine-containing compound, it becomes possible to remarkably improve the dispersibility and dispersion stability of the metal or metal oxide particles and the fluorine-containing resin particles in the coating liquid. Further, by dispersing the fluorine-containing resin particles into a coating liquid wherein the metal or metal oxide particles have been dispersed together with the fluorine-containing compound or the metal or metal oxide particles surface-treated with the fluorine-containing compound have been dispersed, it becomes possible to obtain a coating liquid with good dispersion stability with time and free from formation of the secondary particles of the dispersed particles.

The fluorine-containing compound suitably usable for the above purpose may be a fluorine-containing silane coupling agent, a fluorinated silicone oil or a fluorine-containing surfactant, examples of which may be enumerated hereinbelow. These are however not exhaustive.

[Fluorine-containing silane coupling agents]

$CF_3CH_2CH_2Si(OCH_3)_3$ $C_{10}F_{21}CH_2CH_2SCH_2CH_2Si(OCH_3)_3$ $C_4F_9CH_2CH_2Si(OCH_3)_3$ $C_6F_{13}CH_2CH_2Si(OCH_3)_3$ $C_8F_{17}CH_2CH_2Si(OCH_3)_3$ $C_8F_{17}CH_2CH_2Si(OCH_2CH_2CH_3)_3$ $C_{10}F_{21}Si(OCH_3)_3$ $C_6F_{13}CONHSi(OCH_3)_3$ $C_8F_{17}CONHSi(OCH_3)_3$ $C_7F_{15}CONHCH_2CH_2CH_2Si(OCH_3)_3$ $C_7F_{15}CONHCH_2CH_2CH_2Si(OCH_2CH_3)_3$ $C_7F_{15}COOCH_2CH_2CH_2Si(OCH_3)_3$ $C_7F_{15}COSCH_2CH_2CH_2Si(OCH_3)_3$ $C_7F_{15}SO_2NHCH_2CH_2CH_2Si(OCH_3)_3$ $C_8F_{17}SO_2N(CH_2CH_3)CH_2CH_2CH_2Si(OCH_3)_3$ $C_8F_{17}CH_2CH_2SCH_2CH_2Si(OCH_3)_3$ $C_7F_{15}CON(COC_7F_{15})CH_2CH_2CH_2Si(OCH_2CH_3)_3$ $C_7F_{15}CON(SO_2C_8F_{17})CH_2CH_2CH_2Si(OCH_2CH_3)_3$

[Fluorinated silicone oil]

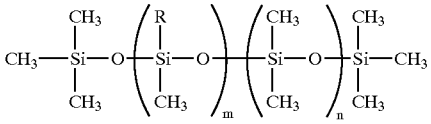

R: —$CH_2CH_2CF_3$, m & n: positive integer

[Fluorine-containing surfactants]

$X—SO_2NRCH_2COOH$ $X—SO_2NRCH_2CH_2O(CH_2CH_2O)_nH$ (n=5, 10, 15)

$X—SO_2N(CH_2CH_2CH_2OH)_2$ $X—RO(CH_2CH_2O)_n$ (n=5, 10, 15)

$X—(RO)_n$ (n=5, 10, 15)

$X—(RO)_nR$ (n=5, 10, 15)

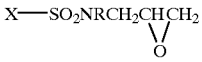

$X—COOH$, $X—CH_2CH_2COOH$ $X—ORCOOH$ $X—ORCH_2COOH$, $X—SO_3H$ $X—ORS_3H$, $X—CH_2CH_2COOH$

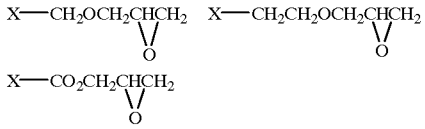

R: alkyl, aryl or aralkyl,

X: fluorocarbon group, such as —$CF_3$, —$C_4F_9$, or —$C_8F_{17}$

For the surface treatment of the metal or metal oxide particles, the metal or metal oxide particles may be mixed and disposed together with a surface-treating agent (fluorine-containing compound) in an appropriate solvent so as to attach the surface-treating agent onto the metal or metal oxide particles. For the dispersion, ordinary dispersion means such as a ball mill or a sand mill, may be used. Then, the solvent may be removed from the dispersion liquid to fix the surface-treating agent onto the metal or metal oxide particles, optionally followed by a heat treatment. As desired, the metal or metal oxide particles after the surface-treatment may be disintegrated or pulverized.

The fluorine-containing compound may be used so as to provide a surface-treating amount of 1–65 wt. %, preferably 1–50 wt. %, based on the total weight of the surface-treated metal or metal oxide particles. The surface-treating amount may be determined based on a heating weight loss after heating the surface treated metal or metal oxide particles up to 505° C. by means of a TG-DTA (thermogravimetric-differential thermal analyzer) or determined based on an ignition loss when heated at 500° C. for 2 hours within a crucible.

As described above, by the dispersion of the metal or metal oxide particles in a coating liquid after the addition of a fluorine-containing compound after the surface-treatment with a fluorine-containing compound, it become positive to stabilize the dispersion of the fluorine-containing resin particles and provide a protective layer with excellent slippability and releasability. However, along with further intensified desire for color image formation, higher image quality and higher stability in recent years, the protective layer is required to exhibit a further improved environmental stability.

As a binder or matrix resin of a protective layer, the present invention uses a cured phenolic resin which shows little change in resistivity in response to an environmental change, provides a hard surface with excellent abrasion resistance and exhibits good and stable dispersion of the fine particles.

In another preferred embodiment of the present invention, a phenolic resin exhibiting a better environmental stability is provided by adding a siloxane compound as represented by formula (1) below into a coating liquid or surface-treating the metal or metal oxide particles with such a siloxane compound prior to the dispersion of the metal or metal oxide particles in the coating liquid:

(1)

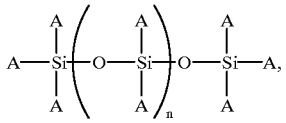

wherein each A represents a hydrogen atom or a methyl group with the proviso that the hydrogen atom occupies 0.1–50% of the A sites, and n is an integer of at least 0.

By using a coating liquid obtained by dispersing the metal or metal oxide particles after addition of the siloxane compound or after the surface-treatment with the siloxane compound, it becomes possible to obtain a coating liquid exhibiting good dispersion stability with time and free from formation of secondary particles of the dispersed particles and provide a protective layer having a high transmittance and excellent environmental stability by using the coating liquid. Moreover, when a protective layer comprising a cured phenolic resin as a binder is formed, the resultant protective layer is liable to be accompanied with streak irregularity or Benard cells, the coating liquid obtained by using siloxane compound as described above can suppress the formation of such streak or Benard cell irregularities to form a smooth surface layer. Thus, the siloxane compound has exhibited an unexpected leveling agent effect.

The molecular weight of the siloxane compound represented by the formula (1) need not be particularly restricted but may preferably be on the order of several hundred to several tens of hundred in terms of a weight-average molecular weight in order to avoid an excessively high viscosity for easiness of surface treatment in the case of the surface treatment.

The surface treatment may be effected in a dry system or a wet system. In the wet treatment, the metal or metal oxide particles may be mixed and dispersed together with the siloxane compound in an appropriate solvent to attach the siloxane compound onto the particle surfaces. For the dispersion, ordinary dispersion means, such as a ball mill or a sand mill, may be used. During the heating for removal of the solvent for attaching the siloxane compound, the Si—H bond in the siloxane bond is oxidized with oxygen in the air to form a new siloxane bond, thereby developing a three-dimensional network structure of siloxane by which the metal or metal oxide particles are covered. In this way, the surface treatment is completed by attachment of the siloxane compound onto the metal or metal oxide particles, but the thus surface-treated particles can be further disintegrated or pulverized, as desired.

In the dry system treatment, the siloxane compound and the metal or metal oxide particles are blended and kneaded without using a solvent to attach the siloxane compound onto the particle surfaces. Thereafter, the particles are heated and pulverized or disintegrated to complete the surface treatment.

The surface-treating amount with the siloxane compound may preferably be 1–50 wt. %, more preferably 3–40 wt. %, based on the surface treated particles, while it can depend on the particle size and ratio of methyl/hydrogen in the siloxane compound.

In the present invention, a cured phenolic resin is used as a binder resin or matrix resin of the protective layer. It is particularly preferred to use a thermosetting resole-type phenolic resin. A resole-type phenolic resin is usually prepared through a reaction between a phenol compound and an aldehyde compound in the presence of a basic catalyst. Examples of the phenol compound may include: phenol, cresol, xylenol, para-alkylphenol, paraphenyl-phenol, resorcin and bisphenols, but these are not exhaustive. On the other hand, examples of the aldehyde compound may include: formaldehyde, para-formaldehyde, furfural and acetaldehyde, but these are not exhaustive.

Such a phenol compound and an aldehyde compound are reacted in the presence of a basic catalyst to provide resoles which are one or a mixture of monomers, such as monomethylphenols, dimethylolphenols and trimethylolphenols, oligomers of these, and mixtures of monomers and oligomers. Among these, molecules having a single recurring unit are called monomers, and relatively large molecules having 2 to ca. 20 recurring units are called oligomers. The basic catalyst used for the resole formation may include: metal-based catalysts inclusive of alkali metal hydroxides and alkaline earth metal hydroxides, such as NaOH, KOH and $Ca(OH)_2$, and basic nitrogen compounds inclusive of ammonium and amines. In view of the resistivity change in a high-humidity environment of the resultant phenolic resin, it is preferred to use a basic nitrogen compound catalyst, particularly an amine catalyst in view of the stability of the coating liquid. Examples of the amine catalyst include: hexamethylenetetramine, trimethylamine, triethylamine and triethanolamine. These are however not exhaustive.

The ratio between the cured phenolic resin and the metal or metal oxide particles is a factor directly determining the resistivity of the protective layer and is set so as to provide the protective layer with a resistivity in a range of $10^{10}$–$10^{16}$ ohm.cm, more preferably $10^{11}$–$10^{14}$ ohm.cm, further preferably $10^{11}$–$10^{13}$ ohm.cm. As the mechanical strength of the phenolic resin is lowered as the content of the metal or metal oxide particles is increased, so that the content of the metal or metal oxide particles should be suppressed as low as possible within an extent that the resistivity and residual potential of the protective layer are kept within an acceptable range.

The protective layer comprises a cured phenolic resin and is preferably cured by heating. The curing temperature is preferably 100–200° C., particularly 120–180° C. The cured state of the phenolic resin can be confirmed by insolubility in an alcohol solvent, such as methanol or ethanol.

The protective layer is set to have a thickness within a range of 1 $\mu$m–7 $\mu$m. Below 1 $\mu$m, a sufficient durability cannot be obtained, and in excess of 7 $\mu$m, the protective layer is caused to have an inferior surface property, thus being liable to result in image defects and an increase in residual potential.

The protective layer can further contain another additive, such as an anti-oxidant.

Next, the organization of the photosensitive layer will be described.

The electrophotographic photosensitive member of the present invention may have either a single layer-type photosensitive layer containing a charge-generating material and a charge-transporting material, or a laminate-type photosensitive layer including a charge generation layer containing a charge-generating material and a charge transport layer containing a charge-transporting material. In view of electrophotographic performance, however, it is preferred to use a laminate-type photosensitive layer including a charge generation layer and a charge transport layer.

Figure 1B:
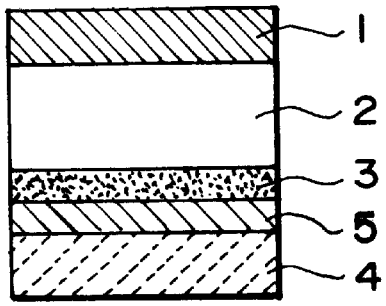
Figure 1C:
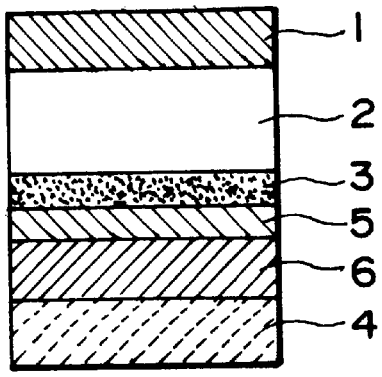

FIGS. 1A–1C show three embodiments of laminate structure of the electrophotographic photosensitive member each including such a laminate-type photosensitive layer. More specifically, the electrophotographic photosensitive member shown in FIG. 1A includes an electroconductive support 4, and a charge generation layer 3 and a charge transport layer 2 successively disposed thereon, and further a protective layer 1 as the surfacemost layer. As shown in FIGS. 1B and 1C, the photosensitive member can further include an undercoating layer 5, and further an electroconductive layer 6 for the purpose of, e.g., preventing the occurrence of interference fringes.

The electroconductive support 4 may be composed of a material which per se shows electroconductivity, such as aluminum, aluminum alloy or stainless steel; such an electroconductive support or a plastic support coated with a vapor deposition layer of aluminum, aluminum alloy or indium oxide-tin oxide campsite; a support comprising plastic or paper impregnated with electroconductive fine particles, such as carbon black, and fine particles of tin oxide, titanium oxide, and silver, together with an appropriate binder resin; or a shaped support comprising an electroconductive resin.

The undercoating layer 5 having a barrier function and an adhesive function may be disposed between the electroconductive layer 4 and the photosensitive layer (2 and 3). More specifically, the undercoating layer 5 is inserted for the purpose of improving the adhesion of the photosensitive layer thereon, improving the applicability of the photosensitive layer, protecting the support, coating defects on the support, improving the charge injection from the support, and protecting the photosensitive layer from electrical breakdown. The undercoating layer 5 may be formed of, e.g., casein, polyvinyl alcohol. ethyl cellulose, ethylene-acrylic acid copolymer, polyamide, modified polyamide, polyurethane, gelatin or aluminum oxide. The undercoating layer 5 may preferably have a thickness of at most 5 μm, particularly 0.2–3 μm.

Examples of the charge-generating material constituting the charge generation layer 3 may include: phthalocyanine pigments, azo pigments, indigo pigments, polycyclic quinone pigments, perylene pigments, quinacridone pigments, azulenium salt pigments, pyrylium dyes, thiopyrylium dyes, squalylium dyes, cyanine dyes, xanthene dyes, quinoneimine dyes, triphenylmethane dyes, styryl dyes, selenium, selenium-tellurium, amorphous silicon, cadmium sulfide and zinc oxide.

The solvent for forming a paint for forming the charge generation layer 3 may be selected depending on the solubility and dispersion stability of the resin and charge-generating material used, e.g., from organic solvents, such as alcohols, sulfoxides, ketones, ethers, esters, aliphatic halogenated hydrocarbons and aromatic compounds.

The charge generation layer 3 may be formed by dispersing and mixing the charge-generating material together with 0.3–4 times by weight thereof of the binder resin and a solvent by means of a homogenizer, an ultrasonic disperser, a ball mill, a sand mill, an attritor or a roll mill to form a coating liquid, which is then applied and dried to form the charge generation layer 3. The thickness may preferably be at most 5 μm, particularly in a range of 0.01–1 μm.

The charge-transporting material may be selected from, e.g., hydrazone compounds, pyrazoline compounds, styryl compounds, oxazole compounds, thiazole compounds, triarylmethane compounds and polyarylalkane compounds.

The charge transport layer 2 may generally be formed by dissolving the charge-transporting material and the binder resin in a solvent to form a coating liquid, followed by application and drying of the coating liquid. The charge-transporting material and the binder resin may be blended in a weight ratio of ca. 2:1 to 1:2. Examples of the solvent may include: ketones, such as acetone and methyl ethyl ketone, aromatic hydrocarbons, such as toluene and xylene, and chlorinated hyrdocarbons, such as chlorobenzene, chloroform and carbon tetrachloride.

For application of the coating liquid, it is possible to use a coating method, such as dip coating, spray coating or spinner coating. The drying may be performed at a temperature of 10–200° C., preferably 20–150° C., for a period of 5 min. to 5 hours, preferably 10 min. to 2 hours, under air blowing or standing.

Examples of the binder resin for forming the charge transport layer 2 may include: acrylic resin, styrene resin, polyester, polycarbonate resin, polyarylate, polysulfone, polyphenylene oxide, epoxy resin, polyurthane resin, alkyl resin and unsaturated resin. Particularly preferred examples thereof may include: polymethyl methacrylate, polystyrene, styrene-acrylonitrile copolymer, polycarbonate resin and diallyl phthalate resin. The charge transport layer 3 may have a thickens of 5–40 μm, prerefarly 10–30 μm.

However, a smaller thickness is generally preferred in view of the resultant image quality, particularly dot reproducibility, and a charge transport layer thickness of 25 μm or above can result in a remarkably worse image quality particularly when a protective layer comprising a phenolic resin is disposed thereon. Accordingly, in the photosensitive member of the present invention including a protective layer 1 comprising a phenolic resin on the charge transport layer 2, the charge transport layer 2 may preferably have a thickness of 5–24 μm, more preferably 10–24 μm, in order to reduce black spots under a severe condition, such as a high-humidity environment.

The charge generation layer 3 or the charge transport layer 2 can further contain various additives, such as an antioxidant, and ultraviolet absorber, and a lubricant.

Next, some description will be made on the process cartridge and the electrophotographic apparatus according to the present invention.

Figure 2:
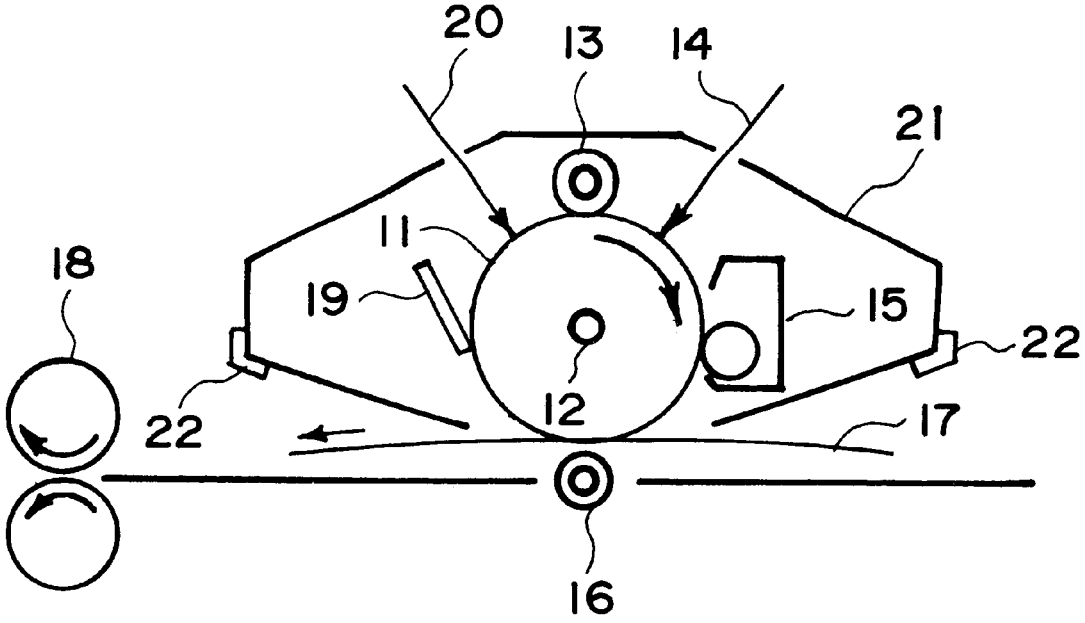
FIG. 2 is a schematic illustration of an electrophotographic apparatus including a process cartridge, which in turn includes an electrophotographic photosensitive member of the invention.

FIG. 2 shows a schematic structural view of an electrophotographic apparatus including a process cartridge using an electrophotographic photosensitive member of the invention. Referring to FIG. 2, a photosensitive member 11 in the form of a drum is rotated about an axis 12 at a prescribed peripheral speed in the direction of the arrow shown inside of the photosensitive member 11. The peripheral surface of the photosensitive member 11 is uniformly charged by means of a primary charger 13 to have a prescribed positive or negative potential. An an exposure part, the photosensitive member 11 is imagewise exposed to light 14 (as by slit exposure or laser beam-scanning exposure) by using an image exposure means (not shown), whereby an electrostatic latent image is successively formed on the surface of the photosensitive member 11. The thus formed electrostatic latent image is developed by using a developing means 15 to form a toner image. The toner image is successively transferred to a transfer (–receiving) material 17 which is supplied from a supply part (not shown) to a position between the photosensitive member 11 and a transfer charger 15 in synchronism with the rotation speed of the photosensitive member 11, by means of the transfer charger 16. The transfer material 17 carrying the toner image thereon is separated from the photosensitive member 11 to be conveyed to a fixing device 18, followed by image fixing to print out the transfer material 17 as a copy outside the electrophotographic apparatus. Residual toner particles remaining on the surface of the photosensitive member 11 after the transfer operation are removed by a cleaning means 19 to provide a cleaned surface, and residual charge on the surface of the photosensitive member 11 is erased by a pre-exposure means issuing pre-exposure light 20 to prepare for the next cycle. The pre-exposure means can be omitted, as the case may be.

According to the present invention, in the electrophotographic apparatus, it is possible to integrally assemble a plurality of elements or components thereof, such as the above-mentioned photosensitive member 11, the primary charger (charging means) 13, the developing means and the cleaning means 19, into a process cartridge detachably mountable to the apparatus main body, such as a copying machine or a laser beam printer. The process cartridge may, for example, be composed of the photosensitive member 11 and at least one of the primary charging means 13, the developing means 15 and cleaning means 19, which are integrally assembled into a single unit capable of being attached to or detached from the apparatus body by the medium of a guiding means such as a rail of the apparatus body.

In the case where the electrophotographic apparatus is used as a copying machine or a printer, for example, the imagewise exposure light 14 may be provided as reflected light or transmitted light from an original, or signal light obtained by reading an original by a sensor, converting the read data into signals, and scanning a laser beam or driving a light-emitting device, such as an LED array or a liquid crystal shutter array, based on the signals.

The electrophotographic photosensitive member according to the present invention may be used not only in an electrophotographic copying machine and a laser beam printer, but also in other electrophotography-applied apparatus, such as a CRT printer, an LED printer, a facsimile apparatus, a liquid crystal printer and a laser plate making.

Hereinbelow, the present invention will be described more specifically with reference to Examples and Comparative Examples wherein "parts" and "%" used for describing a relative amount of a component or a material are by weight unless specifically noted otherwise.

EXAMPLE 1

An aluminum cylinder of 30 mm in diameter and 260.5 mm in length, as a support, was coated by dipping with a coating liquid comprising a 5 wt. %-solution in methanol of a polyamide resin ("AMILAN CM 8000", available from Toray K.K.), followed by drying to form a 0.5 $\mu$m-thick undercoating layer.

Separately, a coating liquid for providing a charge generation layer was prepared by mixing 4 parts of oxytitanium phthalocyanine pigment represented by formula (2) below and characterized by strong peaks at Bragg angles (20±0.2 deg.) of 9.0 deg., 14.2 deg., 23.9 deg. and 27.1 deg. according to Cu Kαcharacteristic X-ray diffraction (2)

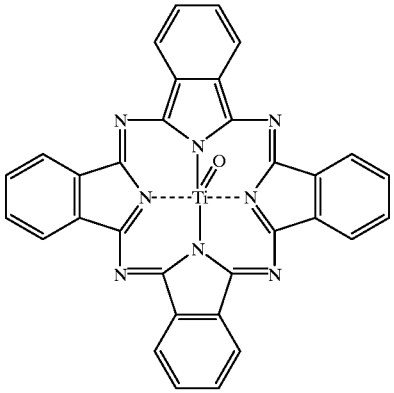

with 2 parts of polyvinyl butyral resin ("BX-1" available from Sekisui Kagaku Kogyo K.K.) and 80 parts of cyclohexanone, dispersing the mixture liquid for 4 hours in a sand mill containing 1 mm-dia. glass beads. The coating liquid was applied by dipping onto the undercoating layer and heated for drying at 105° C. for 10 min. to form a 0.2 $\mu$m-thick charge generation layer.

Then, a solution of 10 parts of a styryl compound of the following formula (3):

(3)

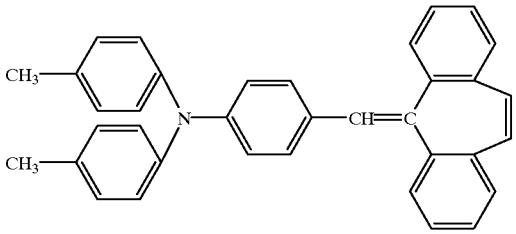

and 110 parts of bisphenol Z-type polycarbonate resin ("Z-200", available from Mitsubishi Gas Kagaku K.K.) in 100 parts of monochrolobenzene, was applied by dipping onto the charge generation layer and heated with hot air for drying at 105° C. for 1 hour to form a 20 $\mu$m-thick charge transport layer.

Then, a coating liquid for providing a protective layer was prepared as follows. First, 50 parts of antimony-doped tin oxide fine particles surface-treated with 7% of a fluorine-containing silane coupling agent represented by formula (4) below:

(4)

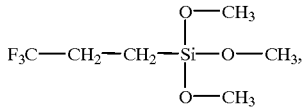

was mixed with 150 parts of ethanol for 66 hours of dispersion in a sand mill to form a dispersion liquid containing the tin oxide particles in a volume-average particle size (Dv) of 0.03 $\mu$m, and then 20 parts of polytrearfluoroethylene fine particles (Dv=0.18 $\mu$m) was added thereto, followed by further 2 hours dispersion. Then, 30 parts (as resin) of resole-type phenolic resin ("PL-4804", made by Gun'ei Kagaku Kogyo K.K., synthesized in the presence of an amine catalyst) was dissolved in the above-formed dispersion liquid to form a coating liquid. Incidentally, the surface-treated antimony-doped tin oxide fine particles exhibited a volume resistivity (Rv) of $1\times10^{12}$ ohm.cm.

The coating liquid was then applied by dipping onto the above-formed charge transport layer and dried and cured by heating with hot air at 145° C. to form a protective layer, which exhibited a thickness of 3 $\mu$m as measured by an instantaneous multi-photometer system ("MCPD-2000" made by Ohtsuka Denshi K.K.) utilizing interference of light. The coating liquid exhibited a good dispersion of the particles therein, and the resultant protective layer provided a uniform surface with no irregularity.

The volume resistivity of the protective layer was measured by forming a separate layer over a polyethylene terephthalate film provided thereon with comb-shaped electrodes of vapor-deposited gold with a gap of 180 $\mu$m with the above-prepared coating liquid, followed similarly by 1 hour of hot air drying and curing at 145° C. Three pieces of the thus formed film samples were left standing in three environments (temperature/humidity) of 23° C./50% RH, 23° C./5% RH and 30° C./80% RH, respectively, and then supplied with a voltage of 100 volts by a tester ("PA-METER 4140B", available from Yokogawa Hewlett Packard K.K.) to measure the volume resistivities in the respective environments.

After observation with eyes for evaluating the surface characteristic, the above-prepared electrophotographic photosensitive member was set in a commercially available laser beam printer ("LASER JET 4000", available from Hewlett-Packard Co.; roller contact charging, AC/DC application), and subjected to measurement of sensitivity (light-part potential(− volts) after uniform charging to a dark-part potential of −600 volts and exposure to a light quantity of 0.4 $\mu J/cm^2$) and then to continuous image formation on 3000 sheets, respectively in an environment of 23° C./50% RH. Thereafter, the abrasion of the surface layer was measured, and after standing in an environment of 30° C./80% RH, image was formed and evaluated the respect to image quality.

Separately, the photosensitive member was subjected to measurement of a residual potential(− volts) after charging to −600 volts and then 0.2 sec. of intense exposure at 10 lux.sec by a drum tester (available from Gentec K.K.) in an environment of 23° C./5% RH. Further, the protective layer coating liquid was left standing for 3 month to evaluate the storage stability.

The results of the resistivity measurement are shown in Table 1 and the other evaluation results are shown in Table 2 together with the results of Examples and Comparative Examples described hereinbelow.

EXAMPLE 2

Example 1 was repeated except that the protective layer thickness was increased to 7 $\mu$m.

EXAMPLES 3 and 4

Photosensitive members were prepared and evaluated in the same manner as in Examples 1 and 2, respectively, except for using a protective layer coating liquid (i.e., a coating liquid providing a protective layer) obtained by reducing the amount of the antimony-doped tin oxide fine particles surface-treated with 7% of the fluorine-coating silane coupling agent of the formula (4) from 50 parts to 20 parts, and further adding 30 parts of antimony-doped tin oxide fine particles surface-treated with 20% of a siloxane compound of formula (1) below (methylhydrogensilocone oil) ("KF-99", available from Shin-Etsu silicone K.K.).

(1)

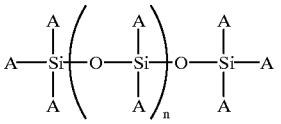

The surface-treated tin oxide particles exhibited $Rv=5\times10^2$ ohm.cm.

EXAMPLE 5

A photosensitive member was prepared and evaluated in the same manner as in Example 1 except for using a protective layer coating liquid obtained by using 50 parts of surface-untreated antimony-doped tin oxide fine particles ("T-1", available from Mitsubishi Material K.K., $Rv=1\times10^{0}$ ohm.cm) instead of the antimony-doped tin oxide fine particles surface-treated with the fluorine-containing silane coupling agent of the formula (4), and further adding 5 parts of the fluorine-containing silane coupling agent of the formula (4) ("LS-1090", available from Shin-Etsu Silicon K.K.).

EXAMPLE 6

A photosensitive member was prepared and evaluated in the same manner as in Example 5 except for using a protective layer coating liquid obtained by further adding 5 parts of methylhydrogensilicone oil of the formula (1) ("KF99", available from Shin-Etsu Silicone K.K.).

COMPARATIVE EXAMPLE 1

A photosensitive member was prepared and evaluated in the same manner as in Example 1 except for using a protective layer coating liquid obtained by omitting the surface-treated antimony-doped tin oxide fine particles (as metal oxide particles) and also the polytetrafluoroethylene fine particles.

EXAMPLES 7–9

Three photosensitive members were prepared and evaluated in the same manner as in Example 3 except for using a protective layer coating liquid obtained by using a resole-type phenolic resin ("PL-4852", made by Gun'ei Kagaku Kogyo K.K., synthesized in the presence of an amine catalyst), a resole-type phenolic resin ("BK-316", made by Showa Kobunshi K.K.) synthesized in the presence of an amine catalyst) and a resole-type phenolic resin ("PL-5294", made by Gun'ei Kagaku Kogyo K.K., synthesized in the presence of a metal-based basic catalyst), respectively, instead of the resole-type phenolic resin ("PL-4804").

EXAMPLE 10

A photosensitive member was prepared and evaluated in the same manner as in Example 3 except for using a protective layer coating liquid obtained by using 30 parts of novolak-type phenolic resin ("CMK-2400", made by Showa Kobunshi K.K.) and 1.5 parts of hexamethylenetetramine (curing agent instead of the resole-type phenolic resin ("PL-4804").

COMPARATIVE EXAMPLES 2 AND 3

Two photosensitive members were prepared and evaluated in the same manner as in Examples 1 and 3, respectively except for using protective layer coating liquids obtained by replacing the resole-type phenolic resin ("PL-4804") with 30 parts of an acrylic monomer of formula (5) below and 2 parts of 2-methyl-thioxanthone (photopolymerizataion initiator), and curing of the coating layers by 60 sec. of photoirradiation at 800 $mW/cm^2$ with a high-pressure mercury lamp followed by 2 hours of drying with hot air at 120° C. to form 3 $\mu$m-thick protective layers.

(5)

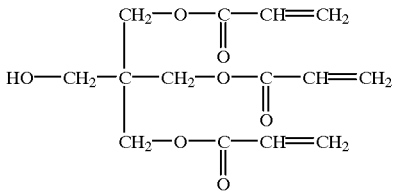

COMPARATIVE EXAMPLES 4 AND 5

Two photosensitive members were prepared and evaluated in the same manner as in Example 1 and 3, respectively, except for using protective layer coating liquids obtained by changing the solvent from ethanol to tetrahydrofuran and replacing the resole-type phenolic resin ("PL-4804") with 30 parts of polycarbonate resin ("Z-200", made by Mitsubishi Gas Kagaku K.K.) to form 3 $\mu$m-thick protective layers by spray coating.

COMPARATIVE EXAMPLE 6

A photosensitive member was prepared and evaluated in the same manner as in Example 10 except for using a protective layer coating liquid obtained by omitting the hexamethylenetetramine (curing agent) to use the novolak-type phenolic resin as a thermoplasic resin.

COMPARATIVE EXAMPLE 7

A photosensitive member was prepared and evaluated in the same manner as in Example 1 except for using a protective layer coating liquid obtained by mixing 10 parts of fluorinated carbon (represented by a formula of $-(CF)_n$ (6), Dv=1 $\mu$m) as electroconductive particles, 100 parts of a resole-type phenolic resin ("Pli-O-Phen J325", made by Dainippon Ink Kagaku Kogyo K.K., synthesized in the presence of an ammonia catalyst) and 500 parts of methanol for dispersion and dissolution.

EXAMPLE 11

A photosensitive member was prepared in the same manner as in Example 3 except for using an aluminum cylinder in a larger length of 357.5 mm and evaluated by setting it in a copying machine ("GP-55", made by Canon K.K., using a corona charger) otherwise in the same manner as in Example 3.

EXAMPLE 12

A photosensitive member was prepared and evaluated in the same manner as in Example 11 except for using a protective layer coating liquid obtained by using 30 parts of novolak-type phenolic resin ("CMK-2400", made by Showa Kobunshi K.K.) and 1.5 parts of hexamethylenetetramine (curing agent) instead of the resole-type phenolic resin ("PL-4804").

EXAMPLE 13

A photosensitive member was prepared and evaluated in the same manner as in Example 1 except for using a resole-type phenolic resin ("Pli-O-Phen J325", made by Dainippon Ink Kagaku Kogyo K.K., synthesized in the presence of an ammonia catalyst) instead of the resole-type phenolic resin ("PL-4804").

COMPARATIVE EXAMPLE 8

A photosensitive member was prepared and evaluated in the same manner as in Example 11 except for using a protective layer coating liquid obtained by replacing the resole-type phenolic resin ("PL-4804") with 30 parts of the acrylic monomer of the above-mentioned formula (5) and 2 parts of 2-methyl-thioxanthone (photopolymerization initiator), and curing of the coating layer by 60 sec. of photoirradiation at 800 mW/cm$^2$ with a high-pressure mercury lamp followed by 2 hours of drying with hot air at 120° C. to form a 3 $\mu$m-thick protective layer.

COMPARATIVE EXAMPLE 9

A photosensitive member was prepared and evaluated in the same manner as in Example 12 except for using a protective layer coating liquid obtained by omitting the hexamethylenetetramine (curing agent) to use the novolak-type phenolic resin as a thermoplastic resin.

COMPARATIVE EXAMPLE 10

A photosensitive member was prepared and evaluated in the same manner as in Example 1 except for increasing the protective layer thickness to 11 $\mu$m.

The results of the above Examples and Comparative Examples are inclusively shown in the following Tables 1 and 2.

TABLE 1

| | Volume resistivity (ohm · cm) | | |
|---|---|---|---|
| | 23° C./50% RH | 23° C./5% RH | 30° C./80% RH |
| Example | | | |
| 1 | $3.5 \times 10^{12}$ | $3.5 \times 10^{12}$ | $1.5 \times 10^{12}$ |
| 2 | $3.5 \times 10^{12}$ | $3.5 \times 10^{12}$ | $1.5 \times 10^{12}$ |
| 3 | $4.0 \times 10^{12}$ | $4.0 \times 10^{12}$ | $3.0 \times 10^{12}$ |
| 4 | $4.0 \times 10^{12}$ | $4.0 \times 10^{12}$ | $3.0 \times 10^{12}$ |
| 5 | $3.0 \times 10^{12}$ | $3.0 \times 10^{12}$ | $1.2 \times 10^{12}$ |
| 6 | $3.5 \times 10^{12}$ | $3.5 \times 10^{12}$ | $2.5 \times 10^{12}$ |
| 7 | $4.0 \times 10^{12}$ | $4.0 \times 10^{12}$ | $3.0 \times 10^{12}$ |
| 8 | $5.0 \times 10^{12}$ | $5.0 \times 10^{12}$ | $4.0 \times 10^{12}$ |
| 9 | $4.0 \times 10^{12}$ | $4.0 \times 10^{12}$ | $3.0 \times 10^{12}$ |
| 10 | $3.5 \times 10^{12}$ | $3.5 \times 10^{12}$ | $1.5 \times 10^{12}$ |
| 11 | $3.5 \times 10^{12}$ | $3.5 \times 10^{12}$ | $1.5 \times 10^{12}$ |
| 12 | $5.0 \times 10^{12}$ | $5.0 \times 10^{12}$ | $4.0 \times 10^{12}$ |
| 13 | $4.5 \times 10^{12}$ | $5.5 \times 10^{12}$ | $1.0 \times 10^{12}$ |
| Comp. Ex. | | | |
| 1 | $\geqq 1.0 \times 10^{14}$ | $\geqq 1.0 \times 10^{14}$ | $\geqq 1.0 \times 10^{14}$ |
| 2 | $5.0 \times 10^{12}$ | $2.0 \times 10^{13}$ | $9.0 \times 10^{9}$ |
| 3 | $5.0 \times 10^{12}$ | $1.0 \times 10^{13}$ | $3.0 \times 10^{10}$ |
| 4 | $3.0 \times 10^{12}$ | $5.0 \times 10^{12}$ | $8.0 \times 10^{11}$ |
| 5 | $3.5 \times 10^{12}$ | $5.0 \times 10^{12}$ | $1.2 \times 10^{12}$ |
| 6 | $3.5 \times 10^{12}$ | $3.5 \times 10^{12}$ | $1.5 \times 10^{12}$ |
| 7 | $8.0 \times 10^{12}$ | $3.0 \times 10^{13}$ | $2.0 \times 10^{11}$ |
| 8 | $5.0 \times 10^{12}$ | $1.0 \times 10^{13}$ | $3.0 \times 10^{10}$ |
| 9 | $3.5 \times 10^{12}$ | $3.5 \times 10^{12}$ | $1.5 \times 10^{12}$ |
| 10 | $3.5 \times 10^{12}$ | $3.5 \times 10^{12}$ | $1.5 \times 10^{12}$ |

TABLE 2

| | After 3000 sheets | | Residual | | | |
|---|---|---|---|---|---|---|
| | Abrasion ($\mu$m) | Image in 30 ° C./ 80% RH | potential in (-volts) 23° C./ 5% RH | liquid storage stability | surface charac-teristic | Sensi-tivity*4 (-volts) |
| Example | | | | | | |
| 1 | 0.1 | good | 40 | good | good | 150 |
| 2 | 0.1 | good | 70 | good | cells*3 | 170 |
| 3 | 0.1 | good | 45 | good | good | 150 |
| 4 | 0.1 | good | 75 | good | good | 175 |
| 5 | 0.1 | good | 38 | good | good | 155 |
| 6 | 0.1 | good | 40 | good | good | 150 |
| 7 | 0.1 | good | 45 | good | good | 150 |
| 8 | 0.1 | good | 50 | good | good | 160 |
| 9 | 0.1 | good | 45 | good | good | 155 |
| 10 | 0.1 | good*1 | 40 | good | good | 150 |
| 11 | 0.1 | good | 45 | good | good | 150 |
| 12 | 1 | good | 45 | good | good | 155 |
| 13 | 0.1 | good*1 | 50 | gelled*2 | turbid | 180 |
| Comp. Ex. | | | | | | |
| 1 | 0.1 | low density | 350 | good | good | 450 |
| 2 | 0.1 | image blur | 110 | good | good | 200 |
| 3 | 0.1 | image blur | 90 | good | good | 190 |
| 4 | 3 | scars | 50 | good | good | 155 |
| 5 | 3 | scars | 45 | good | good | 150 |
| 6 | 2.5 | scars | 45 | good | good | 150 |
| 7 | 0.1 | image blur | 130 | gelled*2 | turbid | 230 |
| 8 | 0.1 | image blur | 90 | good | good | 195 |

TABLE 2-continued

| | After 3000 sheets | | Residual | | | |
|---|---|---|---|---|---|---|
| | Abrasion (μm) | Image in 30 ° C./ 80% RH | potential in (-volts) 23° C./ 5% RH | liquid storage stability | surface charac-teristic | Sensi-tivity*4 (-volts) |
| 9 | 2 | scars | 45 | good | good | 155 |
| 10 | 0.1 | scars | 110 | good | cells*3 | 205 |

*1: good but with slight scars.
*2: gelled in three days.
*3: slightly accompanied with Benard cells.
*4: 0.4 $\mu J/cm^2$, 23° C./50% RH.

As is understood from the results shown in Tables 1 and 2, the protective layer of the photosensitive member of the present invention exhibits a stable resistivity regardless of environmental change, only a low residual potential in a severe environment of low temperature/low humidity, and a tough film strength with little abrasion, and stably results in good images substantially free from image flow even in a high humidity environment.

What is claimed is:

1. An electrophotographic photosensitive member, comprising: a support, a photosensitive layer and a protective layer in this order; wherein said protective layer has a thickness of 1–7 μm and comprises a cured phenolic resin and metal particles or metal oxide particles dispersed therein, wherein the phenolic resin is a resole-type phenolic resin synthesized in the presence of an amine compound.

2. A photosensitive member according to claim 1, wherein said amine compound is selected from the group consisting of hexamethylenetetramine, trimethylamine, triethylamine and triethanolamine.

3. A photosensitive member according to claim 1, wherein said phenolic resin contains lubricant particles.

4. A photosensitive member according to claim 3, wherein the lubricant particles comprise a fluorine-containing resin.

5. A photosensitive member according to claim 1, wherein the photosensitive layer includes a charge generation layer and a charge transport layer disposed on the charge generation layer.

6. A photosensitive member according to claim 5, wherein the charge transport layer has a thickness of 5–24 μm.

7. A process cartridge, comprising: an electrophotographic photosensitive member and at least one means selected from the group consisting of charging means, developing means and cleaning means; said electrophotographic photosensitive member and said at least one means being integrally supported and detachably mountable to a main assembly of an electrophotographic apparatus, wherein said electrophotographic photosensitive member comprises a support, a photosensitive layer and a protective layer in this order, and said protective layer has a thickness of 1–7 μm and comprises a cured phenolic resin and metallic particles or metallic oxide particles dispersed therein, wherein the phenolic resin is a resole-type phenolic resin synthesized in the presence of an amine compound.

8. An electrophotographic apparatus, comprising: an electrophotographic photosensitive member, and charging means, developing means and transfer means respectively disposed opposite to the electrophotographic photosensitive member, wherein said electrophotographic photosensitive member comprises a support, a photosensitive layer and a protective layer in this order, and said protective layer has a thickness of 1–7 μm and comprises a cured phenolic resin and metallic particles or metallic oxide particles dispersed therein, wherein the phenolic resin is a resole-type phenolic resin synthesized in the presence of an amine compound.

9. The electrophotographic photosensitive member of claim 1, wherein the metal particles or metal oxide particles have a volume resistivity of $10^{-1}$–$10^{6}$ ohm.cm.

10. The electrophotographic photosensitive member of claim 1, wherein the metal particles or metal oxide particles have a volume resistivity of $10^{0}$–$10^{5}$ ohm.cm.

11. The process cartridge of claim 7, wherein wherein the metal particles or metal oxide particles have a volume resistivity of $10^{-1}$–$10^{6}$ ohm.cm.

12. The process cartridge of claim 7, wherein the metal particles or metal oxide particles have a volume resistivity of $10^{0}$–$10^{5}$ ohm.cm.

13. The electrophotographic apparatus of claim 8, wherein the metal particles or metal oxide particles have a volume resistivity of $10^{-1}$–$10^{6}$ ohm.cm.

14. The electrophotographic apparatus of claim 8, wherein the metal particles or metal oxide particles have a volume resistivity of $10^{0}$–$10^{5}$ ohm.cm.

* * * * *

UNITED STATES PATENT AND TRADEMARK OFFICE

CERTIFICATE OF CORRECTION

PATENT NO. : 6,492,081 B2 
DATED : December 10, 2002
INVENTOR(S) : Yosuki Morikawa et al.

It is certified that error appears in the above-identified patent and that said Letters Patent is hereby corrected as shown below:

Title page,
Item [56], References Cited, FOREIGN PATENT DOCUMENTS,
JP "57 30846" should read -- 57-30846 --;
JP "62 19254" should read -- 62-19254 --;
JP "1 306857" should read -- 1-306857 --;
JP "2 50167" should read -- 2-50167 --; and
JP "5 181299" should read -- 5-181299 --.

Column 2,
Line 22, "other" should read -- order --.

Column 6,
Line 2, "X__$ORS_3H$," should read -- X__$ORSO_3H$, --.

Column 9,
Line 18, "alcohol." should read -- alcohol, --; and
Line 58, "hyrdocarbons," should read -- hydrocarbons, --.

Column 10,
Line 7, "prerefarly" should read -- preferably --; and
Line 35, "An" should read -- At --.

Column 14,
Line 42, "(photopolymerizataion" should read -- (photopolymerization --.

UNITED STATES PATENT AND TRADEMARK OFFICE

CERTIFICATE OF CORRECTION

PATENT NO. : 6,492,081 B2 
DATED : December 10, 2002
INVENTOR(S) : Yosuki Morikawa et al.

It is certified that error appears in the above-identified patent and that said Letters Patent is hereby corrected as shown below:

Column 18,
Line 33, “wherein wherein” should read -- wherein --.

Signed and Sealed this

Seventh Day of October, 2003

JAMES E. ROGAN
*Director of the United States Patent and Trademark Office*